US005532552A

United States Patent [19]

Heider et al.

[11] Patent Number: 5,532,552

[45] Date of Patent: Jul. 2, 1996

[54] METAL-HALIDE DISCHARGE LAMP WITH CERAMIC DISCHARGE VESSEL, AND METHOD OF ITS MANUFACTURE

[75] Inventors: Juergen Heider, Munich; Stefan Juengst, Zorneding; Peter Wahrendorff, Munich, all of Germany

[73] Assignee: Patent-Treuhand-Gesellschaft F. Elektrische Gluehlampen mbH, Munich, Germany

[21] Appl. No.: 328,492

[22] Filed: Oct. 25, 1994

[30] Foreign Application Priority Data

Nov. 10, 1993 [DE] Germany ..... 43 38 377.7

[51] Int. Cl.[6] ..... H01J 17/04; H01J 17/18

[52] U.S. Cl. ..... 313/623; 313/622; 313/624; 313/625

[58] Field of Search ..... 313/622, 623, 313/624, 625; 501/73

[56] References Cited

U.S. PATENT DOCUMENTS

| | | | |
|---|---|---|---|
| 4,122,042 | 10/1978 | Meden-Piesslinger et al. . | |
| 4,501,799 | 2/1985 | Driessen et al. . | |
| 4,530,909 | 7/1985 | Makishima | 501/73 |
| 4,940,678 | 7/1990 | Aitken | 501/73 |
| 4,980,236 | 12/1990 | Oomen et al. . | |
| 5,099,174 | 3/1992 | Coxon et al. . | |
| 5,446,341 | 8/1995 | Hofmann | 313/623 |

FOREIGN PATENT DOCUMENTS

0472100A3 2/1992 European Pat. Off. .

0587238A1 3/1994 European Pat. Off. .

OTHER PUBLICATIONS

Patent Abstracts of Japan, vol. 12, No. 395 (E-671) Oct. 1988 & JP-A-63 136 456 (Japan Storage Battery Co., Ltd.) Jun. 1988.

*Primary Examiner*—Sandra L. O'Shea
*Assistant Examiner*—John Ning
*Attorney, Agent, or Firm*—Frishauf, Holtz, Goodman, Langer & Chick

[57] ABSTRACT

To provide an effective seal for a metal-halide discharge lamp having a ceramic discharge vessel (4), the seal is formed in multiple parts, in which a first part, adjacent the interior or discharge side of the vessel, includes a melt component (14*a*) which is highly resistant to attack by metal halides within the fill of the lamp. It may contain only 0–12%, by weight, of $SiO_2$ and has a high melting point, in the order of between 1500°–1700° C. The melt-in region remote from the discharge side is melt-sealed by a vitreous composition (14*b*), devoid of pores, voids, bubbles, fissures or cracks, to form an effective, vacuum-tight seal, and protected from attack by the metal halides by the mechanically less stable seal in the first zone. The second composition has a much lower melting point, for example in the order of between 1200°–1400° C., and has 20–40% $SiO_2$. Preferably, and for ease of manufacture, the capillary gap in which the melt seal is formed decreases in dimension towards the discharge side, so that an effective capillary seal can be formed at the higher melting point temperature before the second, lower melting point temperature seal is made.

18 Claims, 4 Drawing Sheets

METAL-HALIDE DISCHARGE LAMP WITH CERAMIC DISCHARGE VESSEL, AND METHOD OF ITS MANUFACTURE

Reference to related patents, the disclosures of which are hereby incorporated by reference: U.S. Pat. No. 4,122,042, Meden-Piesslinger et al, U.S. Pat. No. 4,501,799, Driessen et al, U.S. Pat. No. 4,980,236, Oomen et al, U.S. Pat. No. 5,099,174, Coxon et al.

Reference to related publication, assigned to the assignee of the present invention: Published European Application 0 472 100 A3, Weske et al

FIELD OF THE INVENTION

The present invention relates to a high-pressure discharge lamp, and more particularly to such a lamp which contains a metal-halide fill which aggressively attacks sealing compositions which seal current leadthroughs leading into the interior of the discharge vessel, and especially to a system and construction to eliminate or reduce the effect of such aggression on the seal; and to a method of manufacture of a lamp having this leadthrough system or arrangement.

BACKGROUND

Ceramic discharge vessels, typically made of $Al_2O_3$ ceramic, with or without additives, and using a metal-halide fill, have improved color rendition of light outputs. Typical ratings of such lamps are between 100 to 250 W.

The seal of the feedthrough of conductors leading to the electrode in the interior of the vessel presents a major problem. Frequently, the feedthrough is made of niobium and, often, it is fitted into a plug of ceramic and vacuum-tightly sealed therein by a glass melt, or ceramic sealing material—see, for example, Published European Application 0 472 100 A3, Weske et al, assigned to the assignee of the present application. The metal halides in the fill have a highly corrosive effect on both the niobium feedthrough and the glass melt, so that the useful life of such lamps has been short. A large number of different compositions for glass melts, glass frits, also known as glass solders, have been tested. U.S. Pat. No. 4,122,047, Meden-Piesslinger et al, for example, describes a glass melt which has at least two oxides selected from $SiO_2$, $Al_2O_3$ and $B_2O_3$, and at least one of the oxides of yttrium or lanthanun, or other rare earths. U.S. Pat. No. 5,099,174, Coxon et al, describes a glass sealing composition having a very high content of $SiO_2$ (45–50%, by weight), balance $Al_2O_3$ and MgO. All the glass compositions having a relatively high content of $SiO_2$, ranging between 20–50% by weight, however, are susceptible to reaction with halides.

Other glass sealing compositions having a very low content of $SiO_2$, that is, between 0–20% by weight, have been described in U.S. Pat. No. 4,501,799, Driessen et al, and U.S. Pat. No. 4,980,236, Oomen et al. These compositions use $Al_2O_3$, $Sc_2O_3$ and $TiO_2$, as well as rare earth oxides and alkaline earth oxides, and have very high melting points, that is, 1500°–1700° C. They have, however, unsuitable solidification characteristics and form imperfect seals, subject to leakage.

THE INVENTION

It is an object to provide a high-pressure discharge lamp, having a ceramic discharge vessel, in which the seal resists the attack of halides, so that the lamp has a commercially acceptable, useful operating life, and which, as far as possible, uses components known to be reliable, so that the costs of development are kept low; and to provide a method of manufacture for such a lamp.

Briefly, the sealing system, or sealing arrangement or structure, uses multi-part sealing glasses located in a narrow gap between at least part of the feedthrough and the inner wall of an opening leading into the interior of the vessel, for example in a plug or in an end portion of the vessel itself. A first part of the multi-part sealing glass is located in a first zone of the gap which faces the interior of the vessel and uses a composition highly resistant to attack by halides. Another part of the multi-part sealing glass is located in a second zone of the gap, remote from the interior of the discharge vessel and uses a composition forming an excellent seal. Fortunately, the first part of the multi-part sealing glass has a higher melting point than the other part of the sealing glass remote from the interior of the vessel.

Both the first part and the other part of the sealing composition contain $Al_2O_3$ and at least one further component $M_xO_y$, forming an oxide of the metals lanthanum (La), scandium (Sc), yttrium (Y), rare earth metals, manganese (Mg), zirconium (Zr) and titanium (Ti); the first part of the composition, that is, the one adjacent the discharge side of the seal, may contain 0–12% $SiO_2$; the second composition, remote from the interior of the discharge vessel and, therefore, not directly exposed to metal halides, may contain of between 20–40% $SiO_2$.

In the specification and claims, all quantities and percentages, unless otherwise noted, are by weight.

The suitability of a glass sealing composition system of $Al_2O_3$, $SiO_2$ and $M_xO_y$, where M is a rare earth metal, Mg, Ti or Zr has frequently been discussed.

In accordance with the present invention, the interrelationship of various glass compositions is utilized, so that the desired characteristics of each one is used to effect a composite seal which has a long lifetime, even if the lamp is filled with aggressive metal halides.

The first part of the glass melt is formed of a group of melt glasses which have a relatively high melting point, that is, about 1500°–1700° C. and a relatively low $SiO_2$ content, or none at all. The $SiO_2$ content is between 0–12%. Glass sealing compositions, also referred to as glass melts or glass solders from this first group are hardly attacked by the halides in the lamp fill. In operation of the lamp, the lamp voltage and the light values, that is, color rendition and color temperature, would remain effectively constant throughout the overall lifetime of the lamp. Yet, use of these types of glass compositions for metal-halide lamps has not proven suitable or long-term reliable, because the solidification behavior of these glass compositions is unsatisfactory. Large needle-like crystals of irregular shape are formed during solidification, and the solidified glass melt includes numerous voids, pores or bubbles as a result of insufficient glass desorption during the melting-in, that is, when the seal is being formed. Both these characteristics make the seal region very susceptible to the formation of cracks as the result of the extensive changes in temperature which occur when the lamps are switched ON and OFF. Accordingly, the use of glass solders of this first group results in lamps having an operating lifetime which is commercially unacceptable, that is, less than about 500 hours.

The second group of melt glasses has a relatively low melting point, that is, about 1200°–1400° C. and a high $SiO_2$ content, that is between about 20–40% by weight. This second group of glass solders behaves differently. The low melting point makes them very suitable for melt sealing.

They have a high $SiO_2$ content and, upon solidification, remain mainly vitreous; they do not have a tendency to include voids, pores or bubbles. The susceptibility to form cracks in the region of this seal is less marked, and a long lamp life, that is, an average lifetime of up to 2000 hours could be expected. Yet, the glass solders of this second group have problems which are due to their poor resistance to the attack by halides. The lamp fill reacts with the glass solder, and the lamp voltage and light values suffer a considerable drop already after the first 100 hours of operation. A major portion of the lamp fill is lost because of reaction processes occurring already after about 1000 hours of operation. In spite of satisfactory tightness of the seal, the light values deteriorate to such an extent that no advantage remains over a less expensive metal-halide lamp with a discharge vessel made of quartz glass.

In accordance with the present invention, the best characteristics of the two types of glass solders for seals are used to form a composite seal. The region of the composite seal is divided into zones, preferably into two zones, each using a different type of melt glass or glass solder.

The first zone of the seal region, that is, the zone which faces the discharge, is sealed by a glass solder which is highly resistant to attack by halides. Consequently, this seal uses the glass solders of the first group, which has a high temperature melting point. A second zone of the seal region, that is, the zone which faces away from the discharge, is sealed by a glass solder of the second group which provides an excellent vacuum-tight seal. The glass melts at a much lower temperature, and would be susceptible to attack from halides, but, in accordance with a feature of the present invention, it is protected from such attack by the halides by the glass solder of the first group.

The composite seal thus results in a highly halide resistant seal portion in the zone facing the discharge vessel. Even if microscopically small cracks occur in this zone during the lifetime of the lamp, it nevertheless forms an efficient diffusion barrier for the halides. The glass solder of the second group, then, provides a vacuum-tight seal over a long time. If at all, it is exposed to the attack by the halides only in much weakened form. It is, effectively, protected by the zone having the glass solder of the first group. Further, the temperature loading of the region or zone of the end of the vessel which is remote from the discharge is much lower than that in the first zone, close to the discharge.

The multi-zone or multi-part composite seal is suitable both for sealing a plug into the end of the discharge vessel, as well as for sealing a metallic feedthrough into the plug or, respectively, directly into the end of the discharge vessel.

A sealing plug can be made of ceramics, typically $Al_2O_3$, or of a composite material which has ceramics as a major component. It may also use a conductive material, such as a conductive ceramic, for example a cermet. The metallic feedthrough, preferably, is a niobium pin or a niobium tube. It is also possible to use molybdenum or other refractory materials. Generally, $Al_2O_3$, optionally with dopants, is used as the material for the discharge vessel.

The compositions discussed below for the glass solder are applied as the starting materials. It is known that, during sealing of the plug into the discharge vessel, $Al_2O_3$ is dissolved in the glass solder so that, after completion of the seal, the proportion of $Al_2O_3$ in the glass solder is higher than in a prepared solder ring, by which the glass solder is applied prior to the sealing, see for example U.S. Pat. No. 4,122,042, Meden-Piesslinger et al. Rare earth metals are understood to be the lanthanides, and expressly include the elements Sc, Y and La.

The portion $M_xO_y$ can be formed by several, preferably two or three of the above-indicated oxides; $Sc_2O_3$, $Y_2O_3$ and $La_2O_3$, are particularly suitable for simultaneous use with glass solders, melting at high temperature. For the low temperature part, preferably only one component, $M_xO_y$, particularly an oxide of La, Gd or Dy, is used with the glass solders or glass compositions having the low temperature melting point characteristics. Advantageously, a small quantity of up to 3% of $B_2O_3$ can be added as a fluxing agent.

A preferred composition for the glass solder part resistant to halides, protecting the other part, and melting at high temperature, is 35–70% $Al_2O_3$, 0–12% $SiO_2$, 0–15% $Y_2O_3$, 10–30% $ScO_3$ and 0–30% $La_2O_3$.

A preferred composition for the glass solder part forming the vaccum-tight portion of the composite seal, and having a low temperature melting point contains 5–30% $Al_2O_3$, 20–40% $SiO_2$ and 40–75%, especially 50–60% oxides of the rare earth metals, particularly lanthanum, dysprosium and gadolinium.

As a general rule, for high temperature melting point glasses, the relationship of $Al_2O_3$ to $SiO_2$ should be greater than 1; for low temperature melting point glass compositions, that is, of the second group, the relationship of $Al_2O_3$ to $SiO_2$ is, preferably, less than 1.

When using a multi-component glass seal, the manufacture of the seal becomes complex. It is important that the element to be sealed, that is, melted into an opening at the end of the discharge vessel, is so dimensioned with respect to the opening that, without the melt composition, a small gap remains having capillary properties. The element to be inserted may be a plug into the end of the vessel, a current feedthrough passing through an opening in the plug, or a current feedthrough directly fitted into an end portion of the vessel. Preferably, the gap is so selected that the capillary effect of the gap is stronger in the region or zone facing the discharge. This can be obtained by suitably shaping the gap and/or the element passing through the gap by constricting the width of the gap towards the discharge zone. Either the gap is constricted, or the element being inserted is widened at a region facing the discharge, and inserted into an essentially cylindrical opening. The constriction can be smoothly progressing, that is, in conical form, or stepped.

When making the seal in accordance with the present invention, the part of the feedthrough or plug facing the discharge is first sealed with the glass melt or glass composition or glass solder of the first group, which melts at a high temperature. A paste forming a suspension of the glass solder is coated on the plug or the feedthrough or, optionally, on parts belonging to the electrode shaft. After drying, the paste-coated component, that is, the electrode system having the feedthrough and the electrode, or the paste-coated plug, is inserted into the respective opening in the end of the discharge vessel, and the end of the vessel is heated to the melting temperature, about 1500°–1700° C. This ensures that the paste provides a first or provisionally vacuum-tight seal. Subsequently, the glass solder of the second group, which melts at a low temperature, is applied to the end of the discharge vessel remote from the discharge side, and is sealed in, as known, by heating the end of the vessel to about 1200°–1400° C., so that the glass solder flows into the ring capillary gap in the zone remote from the discharge, and up to the now solidified glass of the first, that is, the high temperature seal which is already in place.

This technique, in accordance with a feature of the invention, uses the advantage derived from selection of the glass solders, so that the glass solder melting at low temperature which forms the outer zone of the seal will not liquify the first glass solder, which melts at high temperature, when the second glass solder is sealed in.

In accordance with a preferred feature of the invention, the two glass solders are so selected that the difference between their melting points is as large as possible and, advantageously, this difference should be more than 100° C. Accordingly, the difference in the $SiO_2$ content of the two glass solders should be 15%, and preferably 20%, or more.

DRAWINGS

Figure 3A:
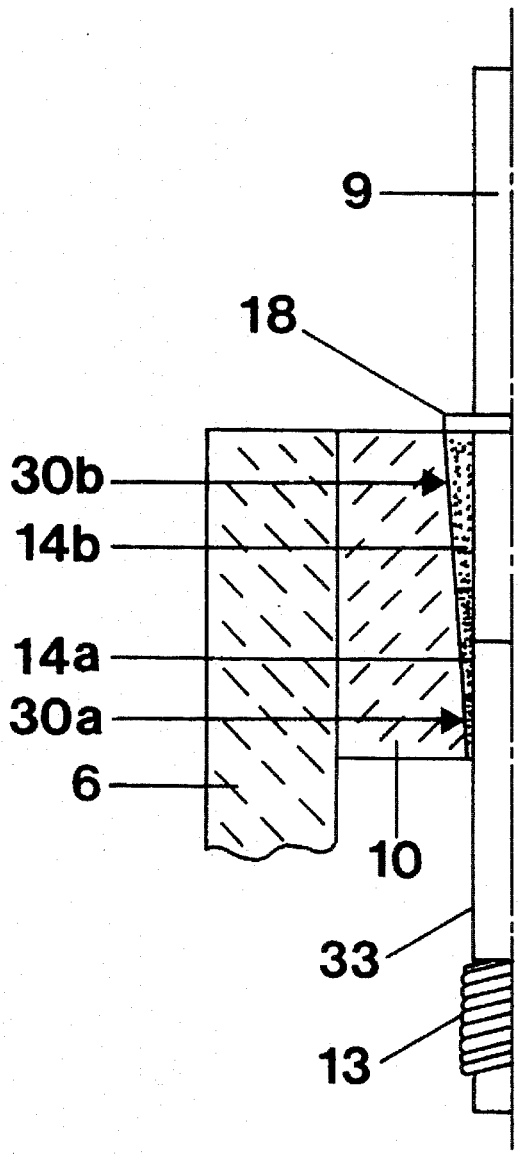
Figure 3B:
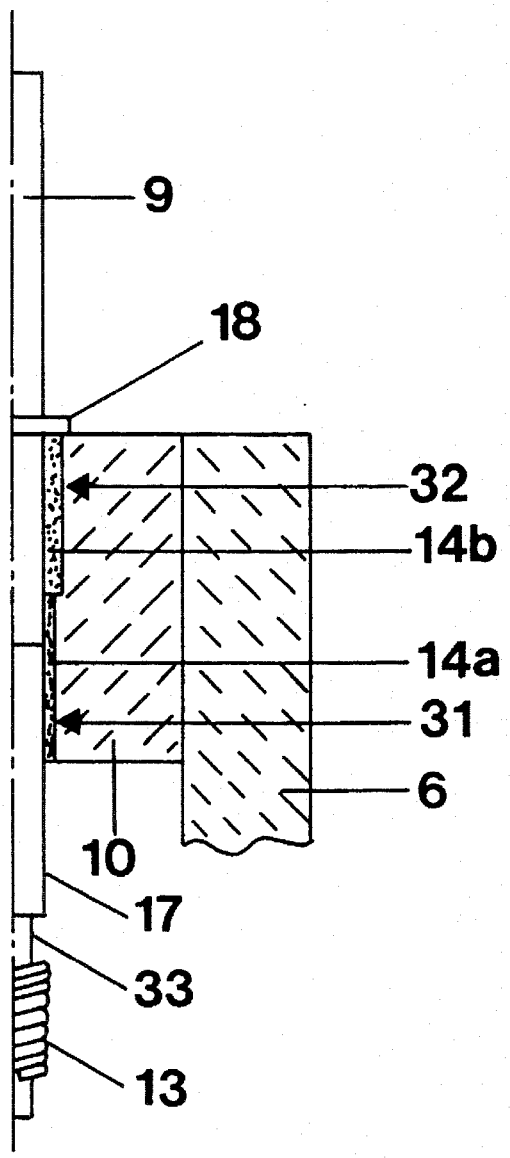
Figure 4:
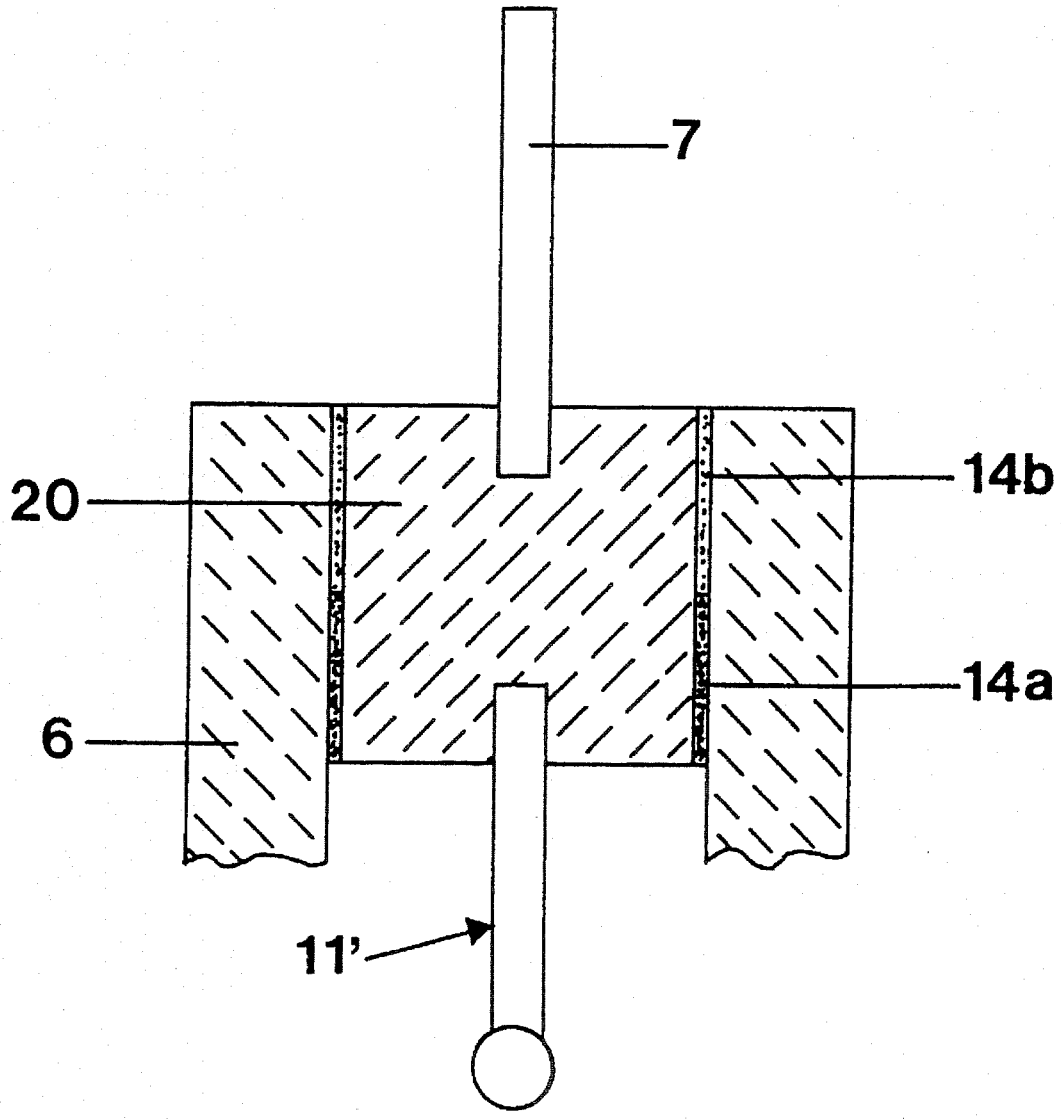

FIGS. 3*a* and 3*b* are vertically half-longitudinal sectional views of the feedthrough region, and illustrating two ways of forming melt-in regions or zones for two glasses; and FIG. 4 is a longitudinal sectional view illustrating another embodiment of the feedthrough region of the lamp.

DETAILED DESCRIPTION

Figure 1:
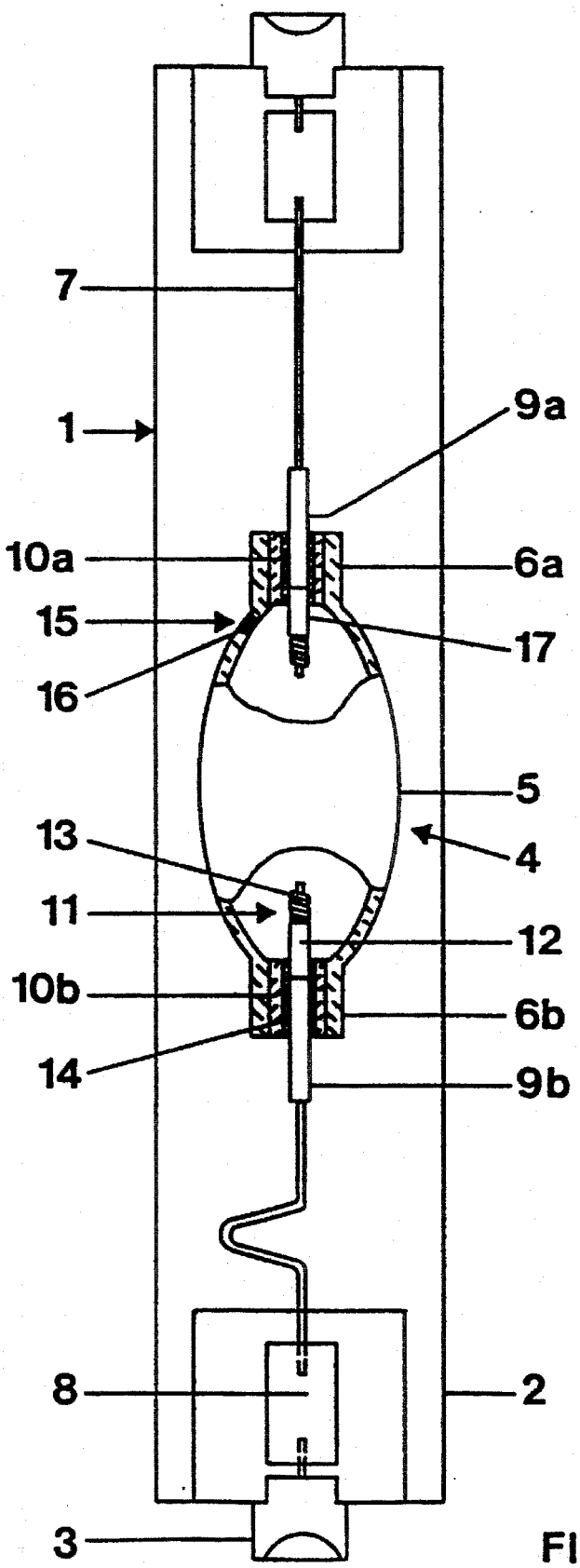
FIG. 1 is a highly schematic side view, partly in section, of a metal-halide discharge lamp.

The metal-halide lamp, shown in a highly schematic view in FIG. 1, has a rated power of 150 W. It is formed of a double-ended cylindrical outer bulb 1 of quartz glass. The bulb 1 defines a lamp axis. It has pinch seals 2 and bases 3 at the ends thereof. An axially aligned discharge vessel 4 of $Al_2O_3$ ceramics, with or without doping additives, is located within the outer bulb 1. It is bulged in the middle, as seen at 5, and has cylindrical ends 6. The shape of the discharge vessel could be different, for example a straight cylindrical tube. The discharge vessel is supported within the outer bulb 1 by two current supply leads 7, connected via foils 8 to the bases 3. Each current supply lead 7 of molybdenum is welded to a feedthrough 9 which is sealed in a ceramic end plug 10 of the discharge vessel by means of glass solder 14. The end plugs are also made of $Al_2O_3$. The fill of the discharge vessel includes an inert starting gas, such as argon, and mercury, as well as additives of metal halides.

The first feedthrough 9*a* is placed in the first end 6*a* which serves as a pumping end for introducing the fill into the lamp. The feedthrough retains an electrode 11 within the interior of the discharge vessel. The electrode 11 has an electrode shaft 12 of tungsten and an electrode head formed by a coil 13 on the end thereof, facing the discharge. The electrode shaft 12 is closely surrounded by a ceramic sleeve 17.

The second feedthrough 9*b* is placed in the second end 6*b* which does not include a fill opening, and thus is a blind end. Both feedthroughs 9 are formed by solid niobium pins, recessed in the bore within the end plug 10.

A fill bore 15 is provided near the pumping end 6*a* to evacuate the discharge vessel and then introduce the fill. After evacuation and filling, the fill bore is closed by a glass solder or a ceramic sealing material 16.

Figure 2:
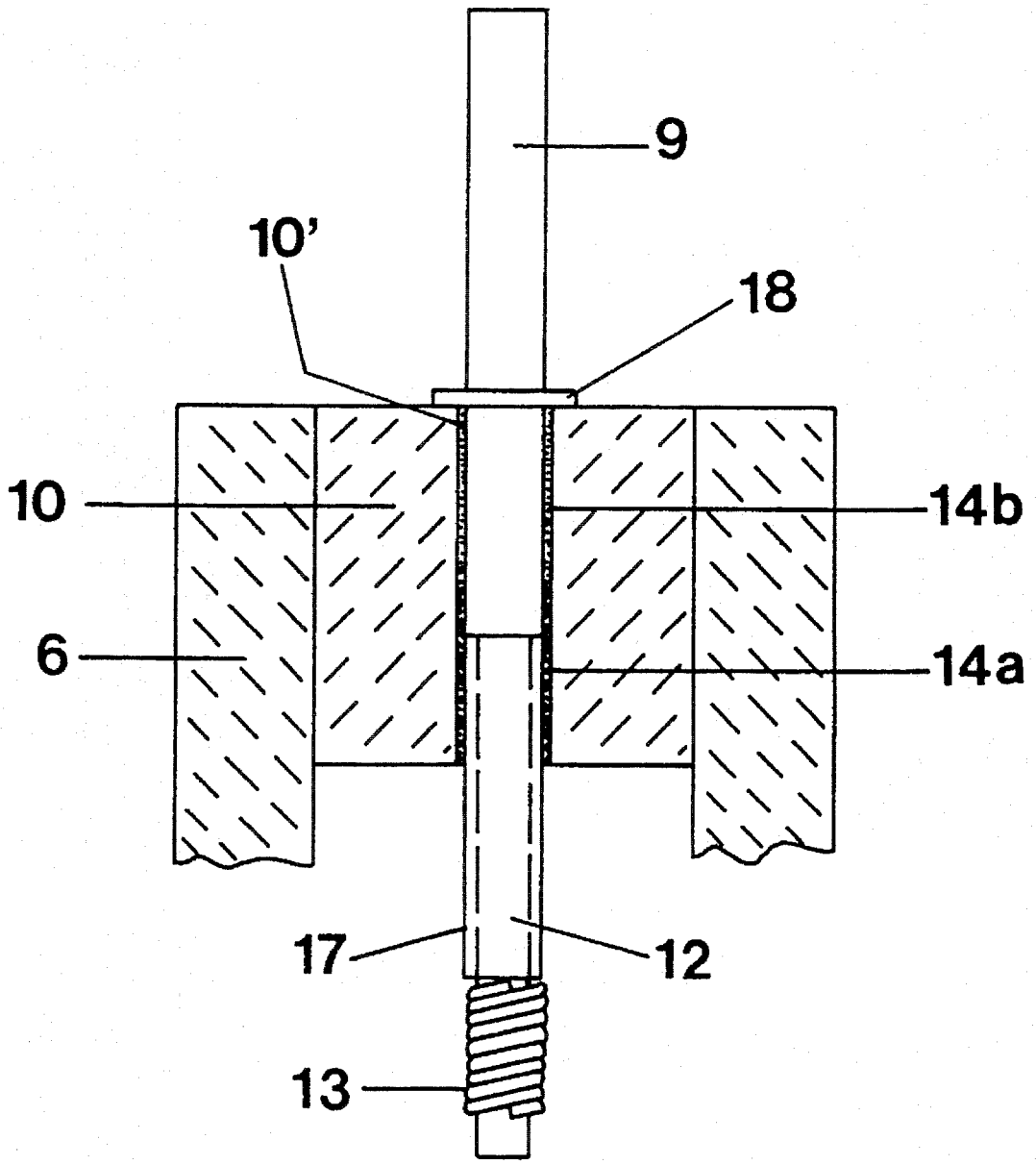
FIG. 2 shows, to an enlarged scale, the feedthrough region of the lamp, partially in longitudinal section.

The detail of the feedthrough region at any one end 6 of the discharge vessel is shown in FIG. 2 in sectional representation. The niobium pin 9 has a diameter of 1.15 mm, and a length of 12 mm. The ceramic plug 10 has an axial length of 5 mm. The niobium pin is inserted in the ceramic plug 10. The electrode shaft 12 of tungsten has a diameter of 0.5 mm and a length of 6.5 mm. It is butt-welded to the end of the niobium pin which faces the discharge. The tip of the electrode shaft carries a coil 13, formed by nine turns, with an outer diameter of 1.1 mm. A ceramic protective sleeve 17 surrounds the electrode shaft 12, and is fixed in position between coil 13 and the niobium pin 9. It has an inner diameter of 0.6 mm, and an outer diameter of 1.1 mm, and an overall length of 3.5 mm. A portion of this length, namely a length of 2 mm, is recessed within the bore in the plug 10. The niobium pin 9 extends outwardly over the remaining 60% of the bore. The correct insertion depth of the niobium pin is ensured by a stop located externally of the plug, for example a turn of a niobium wire 18. The outer diameter of the plug is 3.3 mm, and the diameter of the plug bore 10' is 1.2 mm.

A gap of 0.05 mm will remain between the wall of the bore 10' and the niobium pin 9, or the ceramic sleeve 17, respectively. This gap is sealed with glass solder material 14 over the entire length of the bore.

In accordance with the present invention, the glass solder 14 is formed of multiple zones, as shown by two zones of glass solders 14*a* and 14*b* having different compositions, with respectively different characteristics and different melting points. A first glass composition 14*a*, effectively resistant to attack by metal halides within the fill of the lamp, is used for about the first half of the plug bore in the zone or region which faces the discharge. This composition, also, has a high temperature melting point. Typical compositions are shown in Examples 1–6 of Table I. A second glass solder composition 14*b*, and forming an effective vitreous seal, and having a lower melting point than the first composition, is used for the portion, essentially the second half of the plug bore, remote from the discharge. Suitable compositions are shown in Examples 7–14 of Table II. Both Tables also show the melting points $T_s$ (in °C.).

Method of making the multi-part seal:

The manufacture of a two-zone seal poses a problem. The ring gap between two elements, for example between the inner wall 10*a* of the bore in the plug 10 and the pin 9, creates capillary forces. This gap is present for a certain time before the two elements, namely the feedthrough seal system plug or the plug end-of-the-vessel seal system, are sealed by the glass compositions. Normally, this is desired since the ring gap sucks in the glass composition up to the end of the plug facing the discharge.

When two glass compositions are used, the first glass composition must leave the region of the ring gap remote from the discharge, typically 70–40% of the axial length of the gap free from the first composition to leave space for the second composition. In accordance with a preferred feature of the invention, the ring gap is not a cylindrical gap but, rather, the gap narrows towards the discharge side of the lamp.

In the embodiment of FIG. 3, collectively, elements identical to those in FIG. 2 have been given the same reference numerals. In the FIGS. 3, the plug bore is so dimensioned that capillary forces occur primarily optionally only in the region of the seal facing the discharge. This can be obtained by a conical plug bore 30 (FIG. 3A), or by a two-stage plug bore (FIG. 3B), in which the diameter of the first region 30*a* and 31, respectively, facing the discharge is smaller than the diameter of the second region 30*b* and 32, respectively, remote from the discharge. The feedthrough 9, and the electrode shaft 33 or, respectively, the ceramic sleeve 17, have about the same diameter. The dimensions in FIGS. 3A and 3B are shown to an exaggerated scale, for better illustration.

As another alternative, the reverse arrangement can be used, namely by so selecting the diameter of the shaft and/or preferably of the sleeve 17 surrounding it that it is larger than the diameter of the feedthrough 9 in the zone of composition 14*b* than in the zone of composition 14*a*, and keeping the diameter of the bore constant over the length thereof.

Another embodiment is shown in FIG. 4, in which a plug 20 of an electrically conductive cermet is inserted into the end 6 of the discharge vessel. The cermet plug 20 carries an electrode 11' on the side facing the discharge. A current supply lead 7 is secured to the end remote from the discharge. The cermet plug 20 is sealed into the end 6 of the discharge vessel by two zones of glass solder 14*a*, 14*b*. A glass solder 14*a* of any one of the examples of Table I, resistant to attack by metal halides, and melting at a high temperature, is used for about one-third of the axial length of the plug facing the discharge. A glass solder 14*b*, forming a tight seal, and having a lower melting point temperature, and a composition in accordance with any one of the examples of Table II, is used in the remaining part of the capillary seal remote from the discharge.

Various changes and modifications may be made, and any features described herein, in connection with any one of the embodiments or any one of the compositions, may be used with any of the others, within the scope of the inventive concept.

TABLE I

| | Composition (% by weight) | | | | | $T_s$ |
|---|---|---|---|---|---|---|
| No. | $Al_2O_3$ | $SiO_2$ | $Sc_2O_3$ | $Y_2O_3$ | $La_2O_3$ | (°C.) |
| 1 | 65 | — | 20 | 5 | 10 | 1700 |
| 2 | 48 | — | 24 | 9 | 19 | 1650 |
| 3 | 48 | — | 19 | 8 | 25 | 1620 |
| 4 | 43 | 10 | 17 | 8 | 22 | 1520 |
| 5 | 45 | 5 | 18 | 8 | 24 | 1580 |
| 6 | 47 | 2 | 18.6 | 8 | 24.4 | 1600 |

TABLE II

| | Composition (% by weight) | | | | | | $T_s$ |
|---|---|---|---|---|---|---|---|
| No. | $Al_2O_3$ | $SiO_2$ | $La_2O_3$ | $Dy_2O_3$ | $Gd_2O_3$ | $B_2O_3$ | (°C.) |
| 7 | 10 | 31.5 | 58.5 | — | — | 2.0 | 1250 |
| 8 | 20 | 25.2 | — | — | 54.8 | 1.0 | 1320 |
| 9 | 15 | 29.8 | 55.2 | — | — | 1.0 | 1300 |
| 10 | 15.1 | 29.5 | 54.8 | — | — | 0.6 | 1340 |
| 11 | 15.3 | 29.7 | 55.0 | — | — | — | 1390 |
| 12 | 20 | 26.1 | — | 53.9 | — | 2.0 | 1360 |
| 13 | 13.9 | 32.7 | 52.8 | — | — | 0.6 | 1230 |
| 14 | 15.0 | 29.8 | 55.2 | — | — | 1.0 | 1270 |

Particularly preferred compositions are the combination of a high-melting glass solder free from $SiO_2$ having a low $La_2O_3$ content with a low-melting glass solder having a high $La_2O_3$ content and including a small amount of $B_2O_3$. A particularly preferred combination is the composition of Table I, No. 1, and the composition of Table II, No. 13.

Other suitable combinations of compositions may be used. The selection of the particular composition of Table I and Table II and, respectively, the combination of the compositions, will depend to some extent on economics, namely the cost of the individual components. The characteristics of the specific compositions can also have a bearing, especially the difference between their coefficients of thermal expansion. For example, it is possible to use composition No. 1 of Table I as a first glass solder; then add, as a second component, the composition No. 4 of Table I, which has a melting point of well over 100° C. below the melting point of composition No. 1; and then seal these compositions with a composition of, for example, No. 8 of Table II or No. 14, which has a substantially lower melting point. By suitably dimensioning the gap for capillary infusion of the respective compositions, upon heating to the required melting temperatures, taking care that the already solidified composition of the higher melting point temperature does not re-melt, an effective multicomponent seal can be established, in which the composition, or compositions, of Table I, provide effective resistance to attack by the metal halides of the fill, whereas the composition, or compositions, of the fill from the Table II ensures a vacuum-tight vitreous seal free from pores, voids, bubbles, or fissures.

We claim:

1. A metal-halide discharge lamp having a discharge vessel (4) of ceramic material, said vessel being formed with two open ends (6);

two electrodes (11) located within the discharge vessel;

external current supply means (7);

current leadthroughs (9) connected to the current supply means (7) and to one each of the electrodes, passing through the open ends of the discharge vessel;

a vacuum-tight sealing structure or system, including a sealing composition (14) vacuum-tightly sealing the leadthroughs (9) in the open ends of the vessel; and a fill within the discharge vessel (4) which includes metal halides, wherein, in accordance with the invention, the sealing structure or sealing system comprises a multi-part sealing composition located in a gap, which is formed, at least in part of the said open end, between at least a part of a first means providing, at least as a part thereof, a feedthrough and a second means located at the open end, in which a first part of the multi-part sealing composition essentially consists of a material highly resistant to attack from said metal halides of the fill, is located in a first zone of said gap and faces the interior of the discharge vessel, and in which another part of the multi-part sealing composition essentially consists of a material forming a vacuum-tight vitreous seal devoid of pores, voids, or fissures, is located in another zone of said gap remote from the interior of the sealing vessel; and wherein the first part of the multi-part sealing composition has a melting point higher than that of the other part to define a high melting point composition, and the other part of the sealing composition defines a lower melting point composition;

wherein both the first part and the other part of the composition contain $Al_2O_3$ and at least one further component $M_xO_y$ which are oxides of the metals La, Sc, Y, rare earth metals, Mg, Zr, Ti; and wherein the first part of the composition contains between 0 to 12% $SiO_2$, and the other part of the composition contains between 20–40% $SiO_2$, all percentages by weight.

2. The lamp of claim 1, wherein the first means is a plug (10; 20) and the second means is the end of the discharge vessel;

and wherein said plug forms the current leadthrough (9).

3. The lamp of claim 1, wherein the second means is a plug (10; 20) formed with an opening, and fitted into the open end of the discharge vessel;

and wherein the first means is a separate current leadthrough (9) which is fitted in the opening of said plug.

4. The lamp of claim 1, further including a plug (10) fitted into the open ends (6) of the vessel (4); and a separate current leadthrough;

wherein multipart sealing compositions are used to seal both (a) the respective plugs in the respective open ends of the vessel; and (b) the current leadthrough (9) into an opening of the plug.

5. The lamp of claim 1, further including a protective sleeve (17) surrounding at least part of the electrode (11) adjacent the leadthrough, said protective sleeve being fitted into the opening of the plug.

6. The lamp of claim 1, wherein the content of $SiO_2$ of the first composition is smaller by 15% than the $SiO_2$ content of the second composition.

7. The lamp of claim 1, wherein the content of $SiO_2$ of the first composition is smaller by 20% than the $SiO_2$ content of the second composition.

8. The lamp of claim 1, wherein at least one part of said compositions having the component $M_xO_y$ comprise at least one of the oxides: $Y_2O_3$, $La_2O_3$, $Sc_2O_3$, $Gd_2O_3$, $Dy_2O_3$.

9. The lamp of claim 1, further including up to 3% $B_2O_3$ in the second composition.

10. The lamp of claim 8, wherein the second composition comprises 5–30% $Al_2O_3$, 20–40% $SiO_2$, and 40–75% of oxides of the metals M.

11. The lamp of claim 8, wherein the second composition comprises 5–30% $Al_2O_3$, 20–40% $SiO_2$, and 50–60% of oxides of the metals M.

12. The lamp of claim 9, wherein the second composition comprises 5–30% $Al_2O_3$, 20–40% $SiO_2$, and 40–75% of oxides of the metals M.

13. The lamp of claim 9, wherein the second composition comprises 5–30% $Al_2O_3$, 20–40% $SiO_2$, and 50–60% of oxides of the metals M.

14. The lamp of claim 1, wherein said gap decreases in dimension from an end portion of the end of the vessel towards the discharge side of the end portion of the vessel.

15. The lamp of claim 1, wherein the melting point temperatures of the first part and of the other part of said compositions differ by at least 100° C.

16. A method to make a metal-halide discharge lamp, as claimed in claim 1, comprising the steps of placing the first part of said composition on a first melt region or zone, adjacent the discharge side of the end portion of the vessel;

heating said first region or zone to a first melt temperature $T_1$, to melt said first part of said composition;

placing said other part of said composition on at least a portion of the remaining axial region of said gap to form a second melt region or zone, and heating said second region or zone to a second melt temperature $T_2$ which is less than said temperature $T_1$.

17. The method of claim 16, wherein said temperatures $T_1$ and $T_2$ differ by at least 100° C.

18. The method of claim 16, including the step of providing said gap with a gap dimension which is smaller in the first zone adjacent the discharge side of the vessel than in the second zone remote from the discharge side of the vessel.

* * * * *